US006085054A

United States Patent [19]

Kusayanagi

[11] Patent Number: 6,085,054

[45] Date of Patent: Jul. 4, 2000

[54] WET IMAGE FORMING UNIT AND IMAGE FORMING APPARATUS

[75] Inventor: Toshiya Kusayanagi, Niigata, Japan

[73] Assignee: NEC Corporation, Japan

[21] Appl. No.: 09/312,977

[22] Filed: May 17, 1999

[30] Foreign Application Priority Data

May 18, 1998 [JP] Japan ..... 10-135211

[51] Int. Cl.[7] ..... G03G 15/10

[52] U.S. Cl. ..... 399/249; 15/256.51

[58] Field of Search ..... 15/256, 256.51, 15/256.52; 399/233, 234, 235, 237, 249; 430/117, 118

[56] References Cited

U.S. PATENT DOCUMENTS

| | | | |
|---|---|---|---|
| 5,432,591 | 7/1995 | Geleynse | 399/249 |
| 5,576,815 | 11/1996 | Teschendorf et al. | 399/249 |
| 5,805,963 | 9/1998 | Teschendorf et al. | 399/249 |

FOREIGN PATENT DOCUMENTS

| | | |
|---|---|---|
| 54-155843 | 12/1979 | Japan . |
| 55-137554 | 10/1980 | Japan . |
| 58-82277 | 5/1983 | Japan . |
| 60-28678 | 2/1985 | Japan . |
| 3-168783 | 7/1991 | Japan . |
| 6-19266 | 1/1994 | Japan . |
| 6-314030 | 11/1994 | Japan . |
| 7-175331 | 7/1995 | Japan . |
| 8-123207 | 5/1996 | Japan . |
| 8-211746 | 8/1996 | Japan . |
| 8-254932 | 10/1996 | Japan . |

*Primary Examiner*—Arthur T. Grimley
*Assistant Examiner*—Hoang Ngo
*Attorney, Agent, or Firm*—Ostrolenk, Faber, Gerb & Soffen, LLP

[57] ABSTRACT

A wet image forming unit for developing an electrostatic latent image formed onto a surface of a photosensitive body by a liquid developing solution containing toner particles is characterized in that a squeeze roller for squeezing of a surplus developing solution on the photosensitive body and cleaning the photosensitive body is provided and, just before stop of an image forming operation, a voltage whose polarity is opposite to a charging polarity of the toner particles is applied to the squeeze roller. The squeeze roller rotates in the direction similar to the photosensitive body upon the image forming operation. However, just before the stop of the image forming operation, the squeeze roller rotates in the direction opposite to the photosensitive body. During printing, the liquid developing solution which remains and gathers at the interval between the photosensitive belt and squeeze roller is removed by the reverse rotation of the squeeze roller not only mechanically, but also electrically.

11 Claims, 11 Drawing Sheets

(APPARATUS STOPS)

WET IMAGE FORMING UNIT AND IMAGE FORMING APPARATUS

BACKGROUND OF THE INVENTION

1. Field of the Invention

The present invention relates to a wet image forming unit for forming a developed image by using a liquid developing solution containing toner particles and an image forming apparatus of an electrophotographic system having the image forming unit, more particularly, to a wet image forming unit having a squeeze roller for removing a surplus liquid developing solution from a photosensitive belt and an image forming apparatus.

2. Description of the Prior Art

Hitherto, an image forming apparatus of an electrophotographic system forms a developed image on a photosensitive body by steps of charging, exposing, and developing. Further, the developed image is transferred onto a recording medium by steps of transferring and fixing. As for a developing solution used in the developing step, there is a liquid developing solution having dispersing solution with toner particles. A wet image forming unit using the liquid developing solution forms the developed image on the photosensitive body to which an electrostatic latent image is formed.

In the conventional wet image forming unit, the electrostatic latent image formed on the photosensitive body is developed at an interval between the developing roller and a photosensitive belt by the liquid developing solution supplied from a developing solution supply port. Upon this development, the developing solution adhered to the photosensitive body excessively is squeezed by a squeeze roller. As a result, the image on the photosensitive belt is like a film and by a drying step, after that, transferred to a paper.

In the Official Gazette of Japanese Patent Application Laid-Open No. Hei 8-123207, a squeeze roller is rotated in the direction opposite to the rotational direction of a photosensitive body during development. As disclosed in the Official Gazette of Japanese Patent Application Laid-Open No. Hei 3-168783, a squeeze roller is rotated in the direction similar to the rotational direction of a photosensitive body during development. In those squeeze rollers, when the squeeze roller is rotated in the direction opposite to the photosensitive body during development, there is a fear that a developed image formed on the photosensitive body by a developing roller is disturbed and it is difficult that a pressure of the squeeze roller is set.

Consequently, in view of forming a stable developed image, as shown in the latter disclosure, it is more preferable that the squeeze roller is rotated in the direction similar to the rotational direction of the photosensitive body upon development. In this case, the same voltage potential as that of the developing roller which supplies a liquid developing solution to the photosensitive body is applied to the squeeze roller and, without disturbing the developed image formed by the developing roller, a surplus developing solution can be squeezed.

However, when the operation to squeeze the surplus developing solution by the squeeze roller is performed, a part of the surplus developing solution squeezed from the photosensitive body by the squeeze roller remains and gathers at an interval (gap) between the photosensitive body and the squeeze roller, which is located on the upstream side from the center of a portion where the photosensitive body and the squeeze roller contact. When the image forming apparatus is stopped while holding this state and left as it is, the developing solution which is gathering between the gap dries and congeals. Thus, this exerts a bad influence such that a stain causes upon next printing or the like.

If a force to press the squeeze roller to the photosensitive body so as to strongly rub during development is increased, the photosensitive body is damaged and broken, so that the life is shortened.

The conventional wet image forming unit as mentioned above has a problem that the liquid developing solution cannot be efficiently removed from the photosensitive body and the squeeze roller and a bad influence is exerted upon next printing.

SUMMARY OF THE INVENTION

It is an object of the present invention to provide a wet image forming unit for, just before an image forming apparatus stops, substantially and effectively removing a liquid developing solution which remains and gathers at an interval between a photosensitive body and a squeeze roller which is located on the upstream side from the portion where the photosensitive body and the squeeze roller contact.

According to the present invention, a wet image forming unit for developing an electrostatic latent image formed onto a surface of a photosensitive body by a liquid developing solution containing toner particles is characterized in that a squeeze roller for squeezing of a surplus developing solution on the photosensitive body and cleaning the photosensitive body is provided and, just before stop of an image forming operation, a voltage whose polarity is opposite to a charging polarity of the toner particles is applied to the squeeze roller.

The squeeze roller rotates in the direction similar to the photosensitive body upon the image forming operation. However, just before the stop of the image forming operation, the squeeze roller rotates in the direction opposite to the photosensitive body at the contact portion of the roller and the photosensitive body while contacting with the photosensitive body.

According to the present invention, during printing, the liquid developing solution which remains and gathers at the interval between the photosensitive belt and squeeze roller is removed by the reverse rotation of the squeeze roller not only mechanically, but also electrically. Therefore, there is an effect such that when the apparatus stops, the liquid developing solution is substantially and effectively removed from the photosensitive belt and the squeeze roller.

A wet image forming unit according to the present invention further has a wiper blade for cleaning the liquid developing solution on the squeeze roller and a voltage which potential is the same as that of the squeeze roller is applied to the wiper blade just before the stop of the image forming operation and the wiper blade contacts with the squeeze roller.

Consequently, the surplus liquid developing solution removed by the squeeze roller can be efficiently eliminated by the wiper blade.

In a wet image forming unit according to the present invention, after a voltage whose polarity was opposite to a charging polarity of the toner particles was applied to the squeeze roller just before the stop of the image forming operation, the squeeze roller is separated from the photosensitive body and a voltage whose polarity is the same as the charging polarity of the toner particles is applied to the squeeze roller.

Hence, the liquid developing solution charging to the opposite polarity which remains on the surface of the squeeze roller can be perfectly removed.

In a wet image forming unit according to the present invention, when the squeeze roller is separated from the photosensitive body, the voltage whose polarity is the same as the charging polarity of the toner particles can be applied to the wiper blade.

In a wet image forming unit according to the present invention, the squeeze roller can clean in an area which is not used for the image formation of the photosensitive body.

In a wet image forming unit according to the present invention, in the photosensitive body, mechanical intensity of the area used for cleaning by the squeeze roller can be higher than that of another portion.

According to the present invention, an image forming apparatus for developing an electrostatic latent image formed on a surface of a photosensitive body by a charging unit and an exposing unit by a liquid developing solution containing toner particles and transferring the developed image to a paper by a transfer unit is characterized in that a squeeze roller for squeezing s surplus developing solution on the photosensitive body and for cleaning the photosensitive body is provided and just before stop of an image forming operation, a voltage whose polarity is opposite to a charging polarity of the toner particles is applied to the squeeze roller. Although the squeeze roller rotates in the direction similar to the photosensitive body upon an image forming operation, the squeeze roller, while contacting with the photosensitive body, rotates in the direction opposite to the photosensitive body at the contact portion just before the stop of the image forming operation.

According to the present invention, there is provided an image forming apparatus for developing an electrostatic latent image formed on a surface of a photosensitive body by a charging unit and an exposing unit by a liquid developing solution containing toner particles and transferring the developed image to a paper by a transfer unit by comprising a squeeze roller for squeezing a surplus developing solution on the photosensitive body and cleaning the photosensitive body and a wiper blade for cleaning the liquid developing solution on the squeeze roller. Just before stop of an image forming operation, the squeeze roller, while contacting with the photosensitive body, rotates in the direction opposite to the photosensitive body at the contact portion and a voltage whose polarity is opposite to a charging polarity of the toner particles to the squeeze roller. A voltage whose potential is the same as the squeeze roller is applied to the wiper blade and the wiper blade contacts with the squeeze roller. Further, after the voltage whose polarity was opposite to the charging polarity of the toner particles was applied to the squeeze roller, the roller is separated from the photosensitive body and the voltage whose polarity is the same as the charging polarity of the toner particles. When the squeeze roller is separated from the photosensitive body, a voltage whose polarity is the same as the charging polarity of the toner particles can be applied to the wiper blade.

DETAILED DESCRIPTION OF THE PREFERRED EMBODIMENTS

Figure 1:
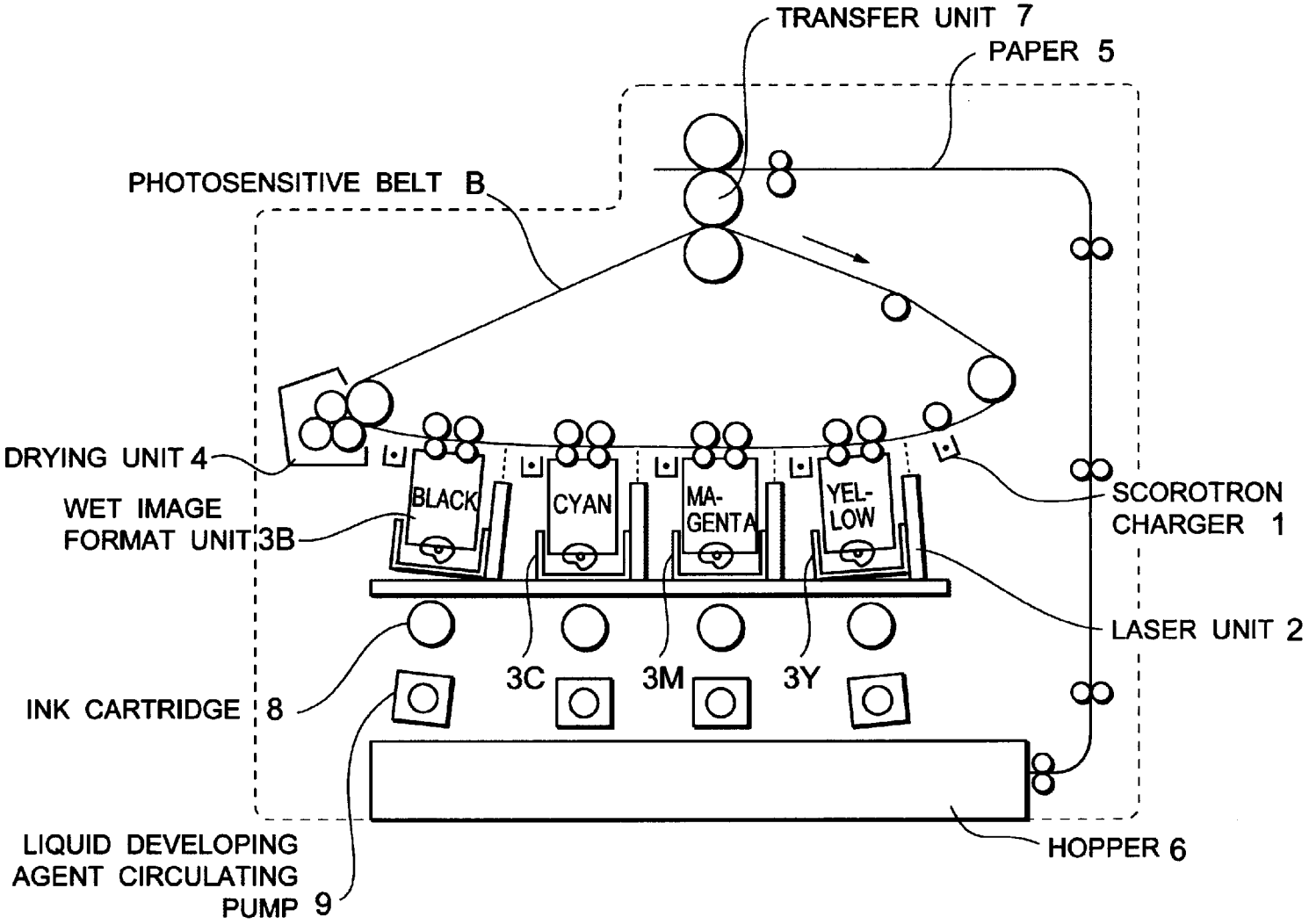
FIG. 1 is a schematic section view of an image forming apparatus of embodiments according to the present invention.

The embodiments according to the present invention will now be described with reference to the drawings. FIG. 1 is a whole constructional diagram showing an image forming apparatus of the embodiments according to the present invention. The image forming apparatus according to the present invention prints using an electrophotographic system and is used as printer, plotter, copying apparatus, facsimile, or the like.

With reference to FIG. 1, a photosensitive belt B is charged by a scorotron charger 1, exposed by a laser unit 2, and a latent image is formed. The latent image is developed by a wet image forming unit 3 (as shown by symbols of 3B, 3C, 3M, and 3Y) using a liquid developing solution of four colors of yellow, msolutiona, cyan, and black and the developed image is formed on the photosensitive belt B. The developed image is dried by a drying unit 4. A liquid developing solution of an ink cartridge 8 is supplied to each wet image forming unit by a liquid developing solution circulating pump (not shown). A paper 5 is fed from a hopper 6 and the image on the photosensitive belt B is transferred by a transfer unit 7. By the above processes, an image formation is performed. FIG. 1 shows an example where four wet image forming units 3 (3B, 3C, 3M, 3Y) are used and a full-color image is formed by toner of four colors of yellow, magenta, cyan, and black. The present invention is not limited by four colors, but can be applied to the image formation of a single color or two colors.

As for the liquid developing solution, color powder toner particles (hereinlater, called toner) of four colors of yellow, msolutiona, cyan, and black which are dispersed in a dispersing solution.

Figure 2:
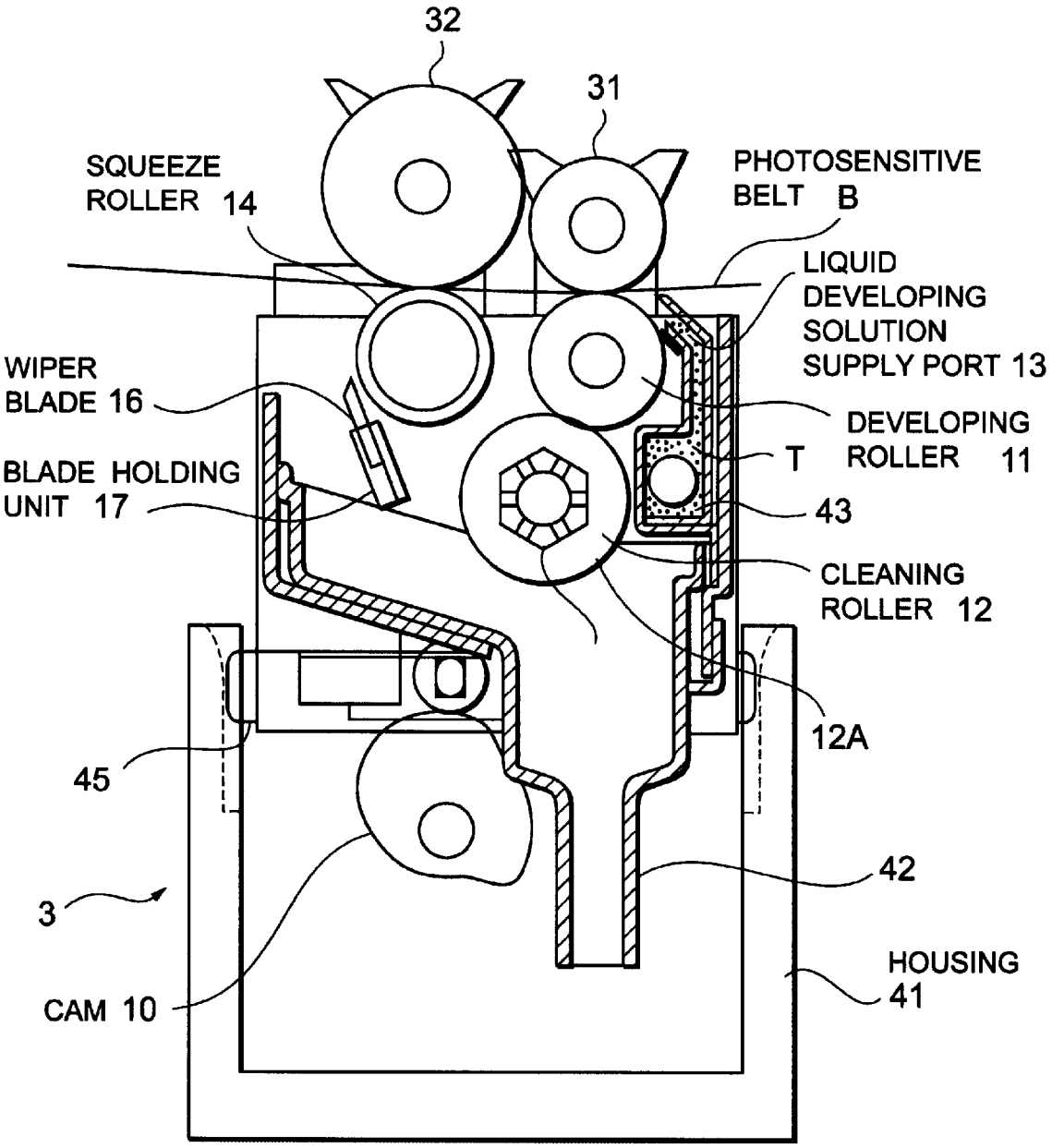
FIG. 2 is a section view of a wet image forming unit used for the image forming apparatus in FIG. 1.
Figure 3:
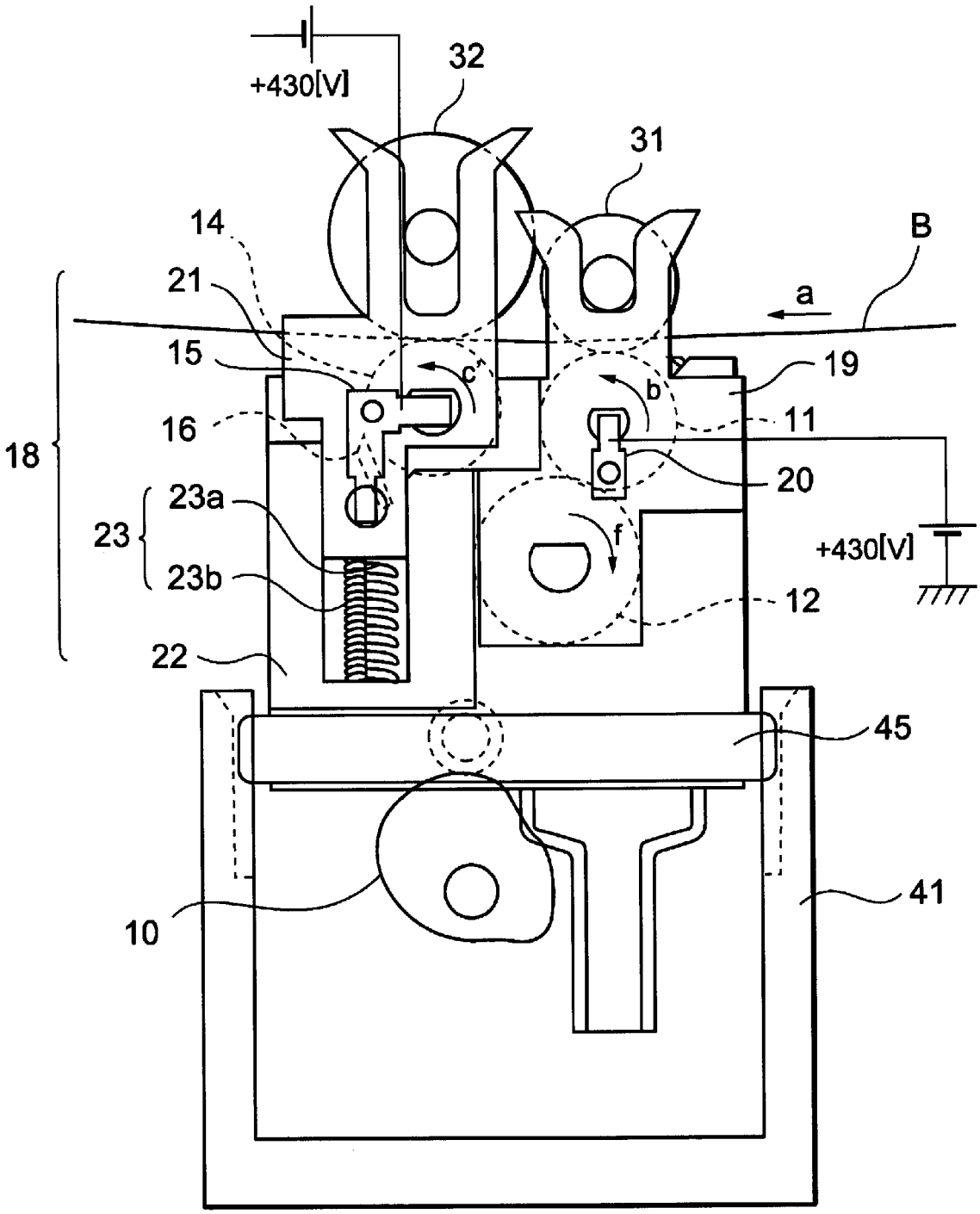
FIG. 3 is a side elevation view of the wet image forming unit in FIG. 2 and showing a state during printing (upper stage of a cam)

FIG. 2 is a section view showing the first embodiment of the wet image forming unit 3 in the image forming apparatus in FIG. 1. FIG. 3 is a side elevation view of the wet image forming unit 3 and for showing a state during printing (upper stage of a cam). The section view of FIG. 2 shows a state where a central portion of a developing roller used by the wet image forming unit 3 is cut.

With reference to FIGS. 2 and 3, the wet image forming unit 3 according to the first embodiment has a housing 41, an accumulating chamber 43 for temporarily holding a liquid developing solution T supplied via a supply pipe (not shown) from the ink cartridge 8 in FIG. 1, a liquid developing solution supply port 13 connected to the accumulating chamber 43, a developing roller 11, a cleaning roller 12, a squeeze roller 14, and a wiper blade 16.

A connecting pipe 42 is a pipe for returning the liquid developing solution which has been cleaned and removed by the cleaning roller 12, squeeze roller 14, and wiper blade 16 to the ink cartridge 8 and for again using it.

The developing roller 11 develops to an area where the electrostatic latent image formed on the photosensitive belt B. While developing, the roller 11 rotates in the direction similar to the rotational direction of the photosensitive belt B. A driven roller 31 rotates while facing to the developing roller 11. As shown in FIG. 3, the developing roller 11 has a developing terminal 20 at one end and a developing voltage is applied from the developing terminal.

The cleaning roller 12 cleans the developing roller 11 while contacting with the developing roller 11.

The squeeze roller 14 squeezes a surplus developing solution on the photosensitive belt B during printing and just before the apparatus stops (that is: before image forming operation stops), it rotates in the opposite direction and cleans the photosensitive belt B. A rotational roller 32 is faced to the squeeze roller 14. The wiper blade 16 has a semiconductive urethane rubber (the resistance value within a range of $1\times10^4$ to $1\times10^6$ Ω). When the squeeze roller 14 cleans the photosensitive belt B, the wiper blade 16 is pressed to the squeeze roller 14 and the surplus liquid developing solution squeezed by the squeeze roller 14 is removed. The wiper blade 16 is held by a blade holding unit 17. As shown in FIG. 3, a squeeze terminal 15 is connected to one end of the squeeze roller 14. A voltage is applied to the squeeze roller 14 and blade holding unit 17 from the squeeze terminal 15.

As shown in FIG. 3, a squeeze supporter 18 supports the squeeze roller 14 and blade holding unit 17. A developing roller supporter 19 supports the developing roller 11, cleaning roller 12 and the accumulating chamber 43. The squeeze supporter 18 and developing roller supporter 19 are fixed to a holding plate 45 which operates in the vertical direction in the housing 41 by rotation of a cam 10.

Therefore, with respect to the developing roller 11 and cleaning roller 12, and the squeeze roller 14 and wiper blade 16, distances from the photosensitive belt B can be varied by rotation of the cam 10. But, position of the driven roller 31 and the rotational roller 32 is invariable.

Each portion will be described in detail. The developing roller 11 is a metal cylindrical member and supported rotatably by the developing roller supporter 19 at the both ends of the developing roller 11. A developing terminal 20 which is a plate-shaped metal member contacts with the shaft end portion of the developing roller 11. Upon developing, a developing voltage is applied to the developing roller 11 from the developing terminal 20. During developing, the developing roller 11 is arranged at a position where a minute interval (about 150 [μm]) between the roller 11 and photosensitive belt B is held and is rotated in the direction of an arrow b in FIG. 3. The liquid developing solution supplied from the liquid developing solution supply port 13 is conveyed to the minute interval and the electrostatic latent image formed on the photosensitive belt B is developed. At this time, an electric field functions between the developing roller 11 and photosensitive belt B by a voltage applied to the developing terminal 20 of the developing roller 11 and toner in the developing solution moves toward the electrostatic latent image of the photosensitive belt B by electrophoresis.

Movement of toner toward the photosensitive belt B by electrophoresis does not cause in an area where the electrostatic latent image is not formed. In this area, although the liquid developing solution adheres to the surface of the photosensitive belt, the electrostatic adhesion is weak, so that it can be squeezed by the squeeze roller 14 after development by the developing roller 11.

Just before the developing operation is finished and the apparatus stops or after formation of the developed image corresponding to the first sheet, the developing roller 11 widely separates from the photosensitive belt B.

By contacting with the developing roller 11, the cleaning roller 12 is rotatably supported to the developing roller supporter 19. As shown in FIG. 2, the cleaning roller 12 is a cylindrical member whose length is the same as that of the developing roller 11, substantially. A roller portion 12A is a spongy member. A shaft portion 12B is a metal member whose core is empty. The shape of the portion to which the roller portion 12A is attached in the shaft portion 12B is hexagonal. A large number of small holes are opened on each side of the hexagonal portion. The liquid developing solution T is supplied to the shaft portion 12B whose core is empty and supplied to the spongy roller portion 12A from a large number of small holes of the shaft portion 12B. The cleaning roller 12 is come into contact with the surface of the outer rim of the developing roller 11 by a predetermined pressure and rotated in the direction shown by an arrow fin FIG. 3 upon developing operation. The remaining liquid developing solution on the developing roller 11 without being developed is cleaned by the liquid developing solution T oozed from the roller portion 12B.

The squeeze roller 14 is a cylindrical member longer than the developing roller 11. The roller portion is constructed by a semiconductive urethane rubber (the resistance value within a range of $1\times10^4$ to $1\times10^6$ Ω). The shaft portion is constructed by a metal member whose core is empty and rotatably supported by the squeeze roller supporter 21 at both ends of the squeeze roller 14. The squeeze roller supporter 21 is fixed to the squeeze supporter 18.

The squeeze supporter 18 is provided with the wiper blade holding unit 17 for holding the wiper blade 16, the squeeze roller supporter 21, a spring member 23 having a compressing coil spring 23*a* and a compressing coil spring 23*b*, and a spring bearing 22. The supporter 18 is fixed to the holding plate 45 via the spring bearing 22. The squeeze roller supporter 21 is fixed to one end of each of the compressing coil springs 23*a* and 23*b* and presses the squeeze roller 14 to the rotational roller 32 by spring elasticity.

Figure 9:
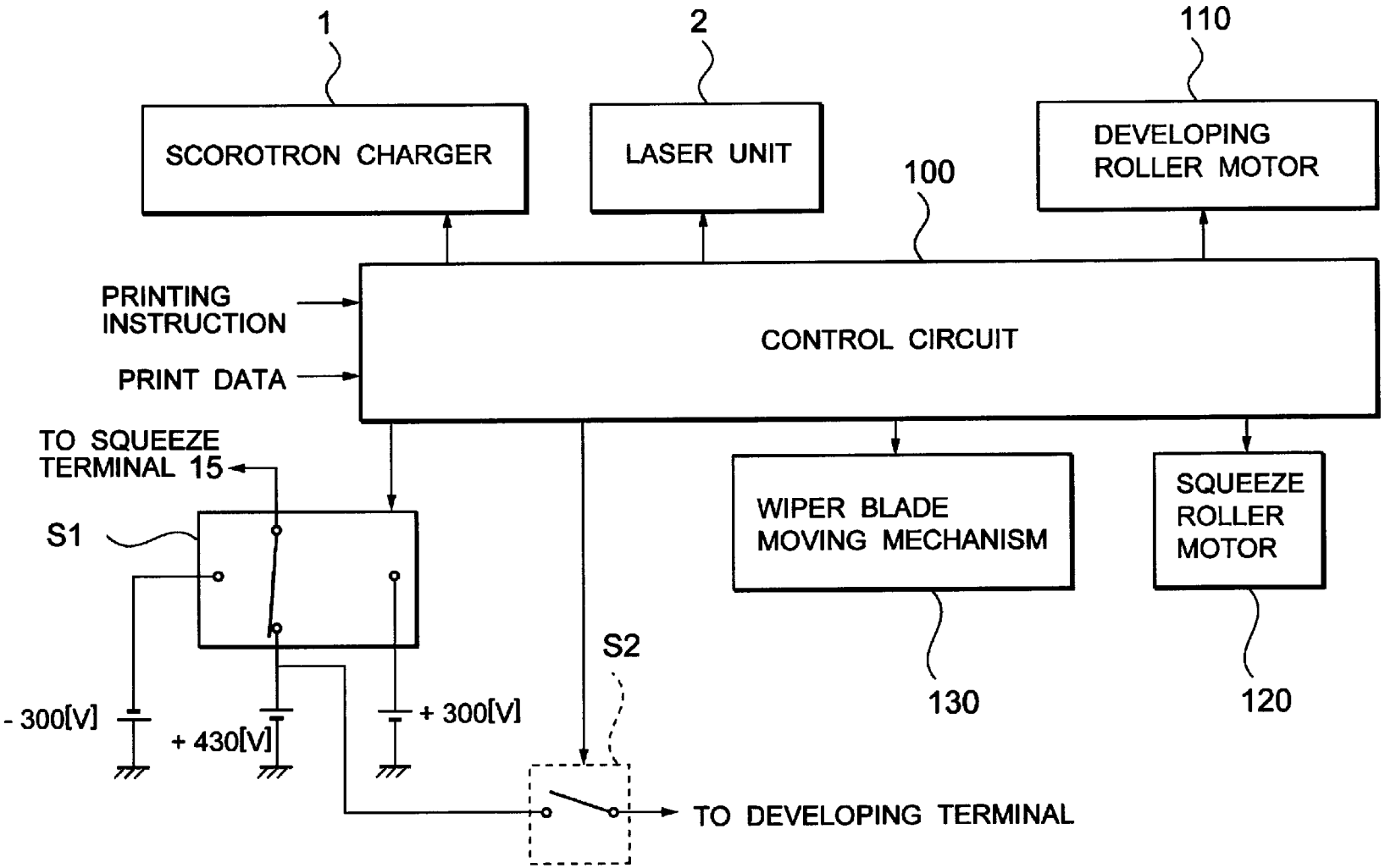
FIG. 9 is a block diagram showing an electric circuit of the image forming apparatus in FIG. 1.

FIG. 9 is a block diagram of an electric circuit system in the image forming apparatus according to the embodiment of the present invention. In FIG. 9, a control operation of the whole image forming apparatus is executed by a control circuit 100. The scorotron charger 1, the laser unit 2 for exposure, a developing roller motor 110, a squeeze roller motor 120, a wiper blade moving mechanism 130, and switching circuits S1 and S2 are connected to the control circuit 100, and the above component elements are controlled, respectively.

The developing roller motor 110 drives the developing roller 11. The squeeze roller motor 120 drives the squeeze roller 14. The wiper blade moving mechanism 130 is fixed to the wiper blade holding unit 17 and allows the wiper blade 16 to contact or separate with/from the squeeze roller 14 by a predetermined pressure.

The switching circuit S1 is connected to the squeeze terminal 15 in FIG. 3 and switches voltages of +430V, +300V, and −300V of the power source by the control operation of the control circuit 100. The switching circuit S2 is connected to the developing terminal 20 in FIG. 3, closed by the control operation of the control circuit 100, and a voltage of +430V is applied to the developing roller 11.

Subsequently, an operation of the wet image forming unit 3 will be now described.

Figure 4:
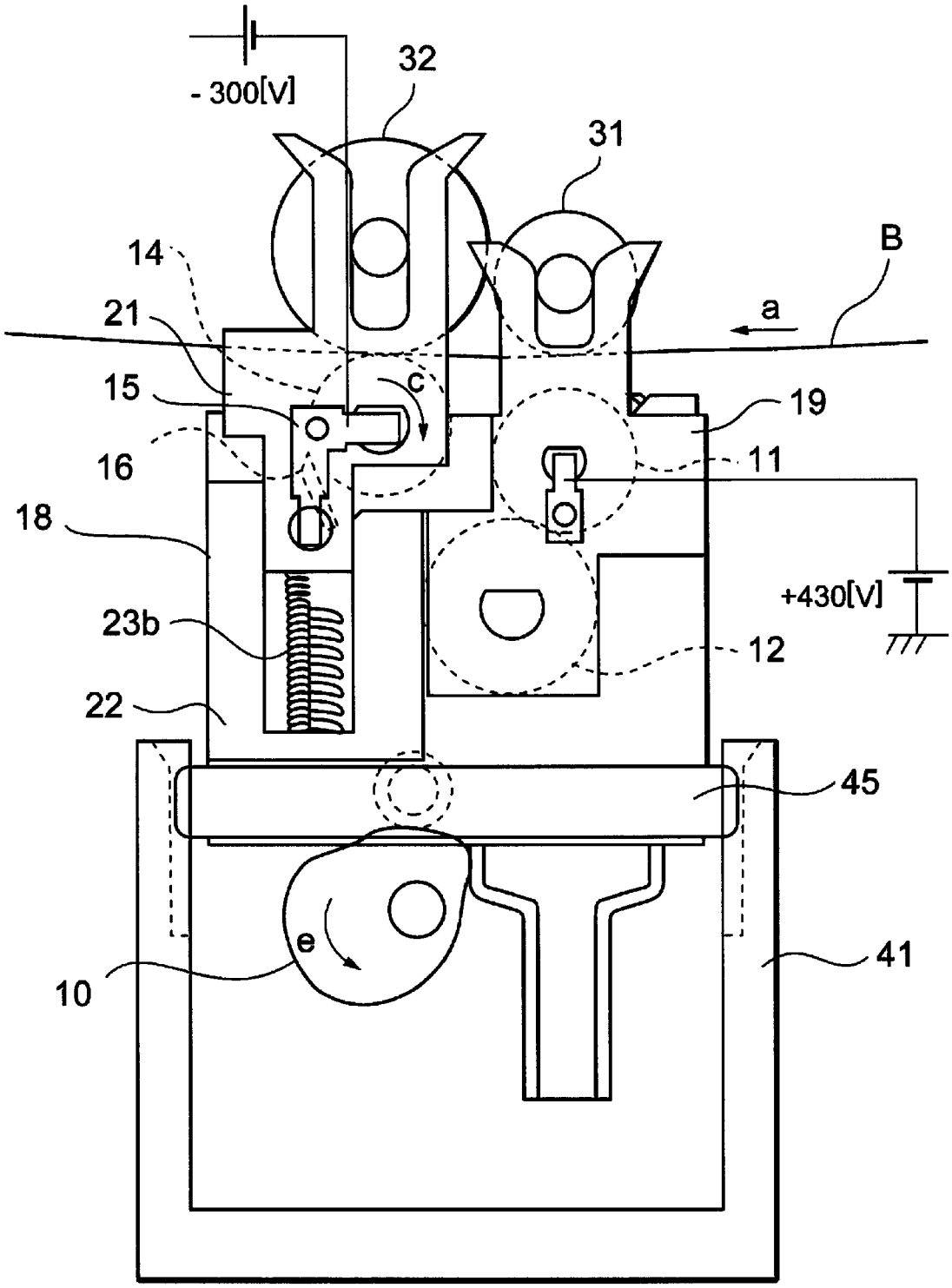
FIG. 4 is a side elevation view showing a state just before the wet image forming unit in FIG. 2 stops printing (middle stage of the cam)
Figure 5:
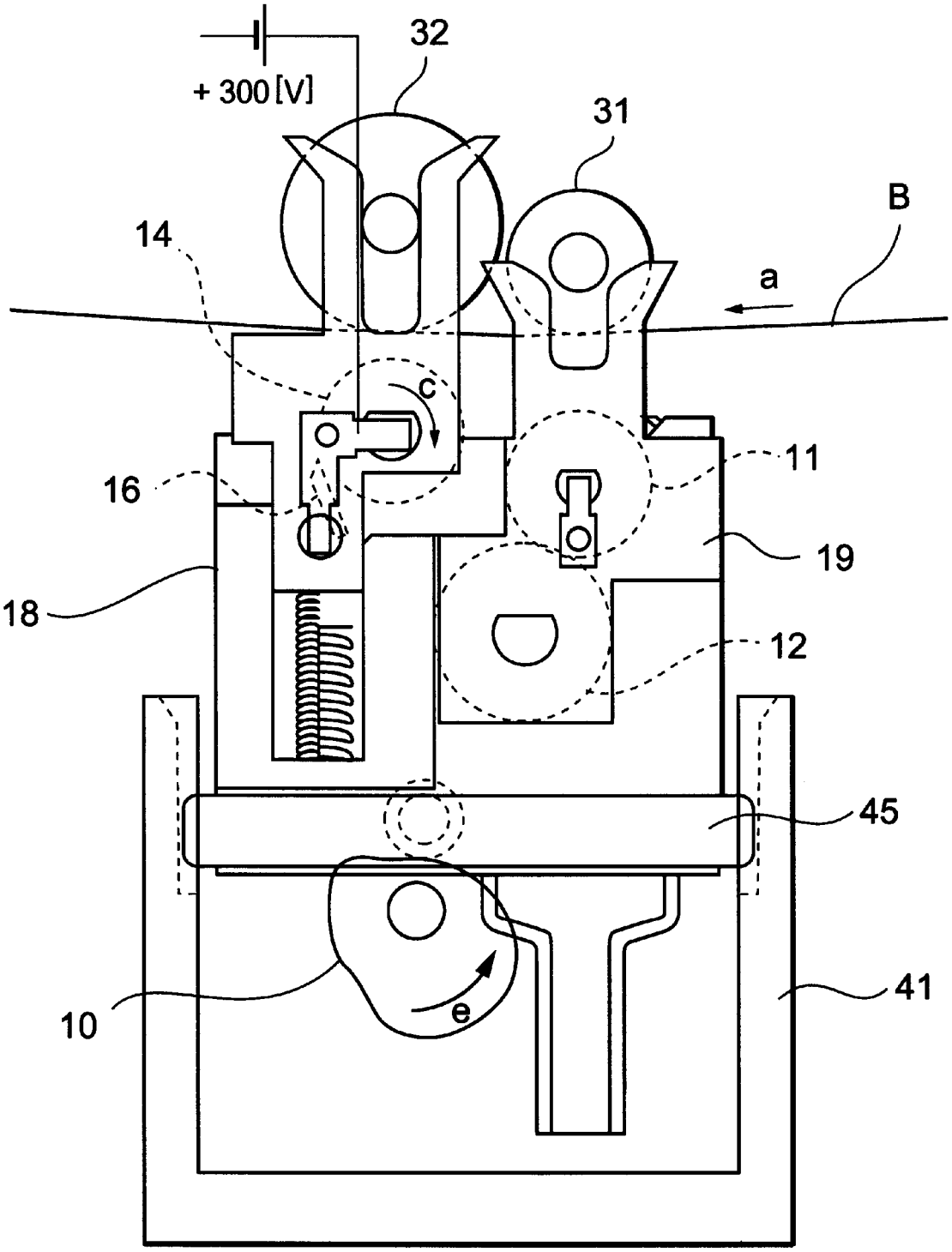
FIG. 5 is a side elevation view showing a state just before the wet image forming unit in FIG. 2 stops printing (lower stage of the cam)
Figure 6:
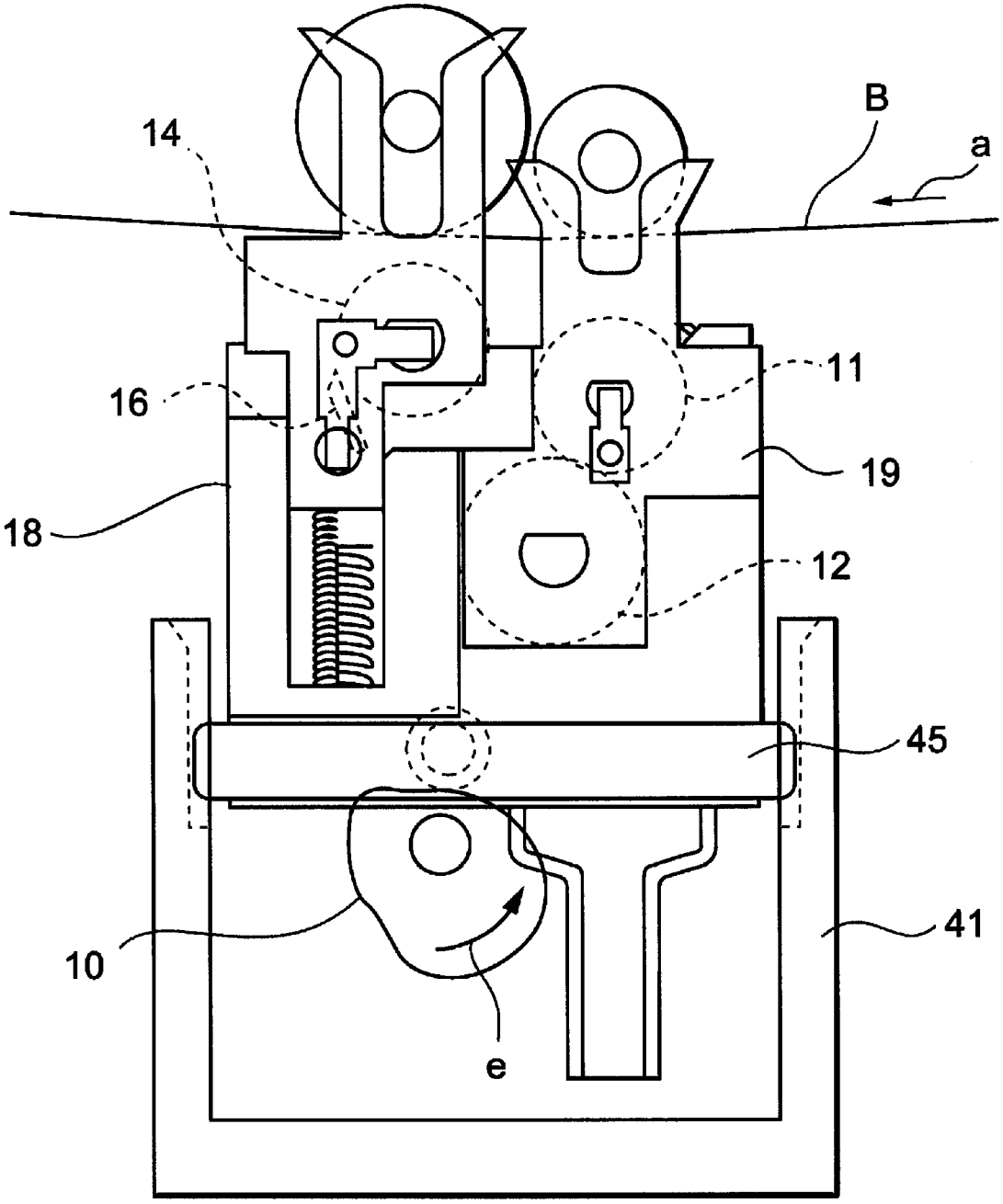
FIG. 6 is a side elevation view showing a state when the wet image forming unit in FIG. 2 stops printing (lower stage of the cam)
Figure 7:
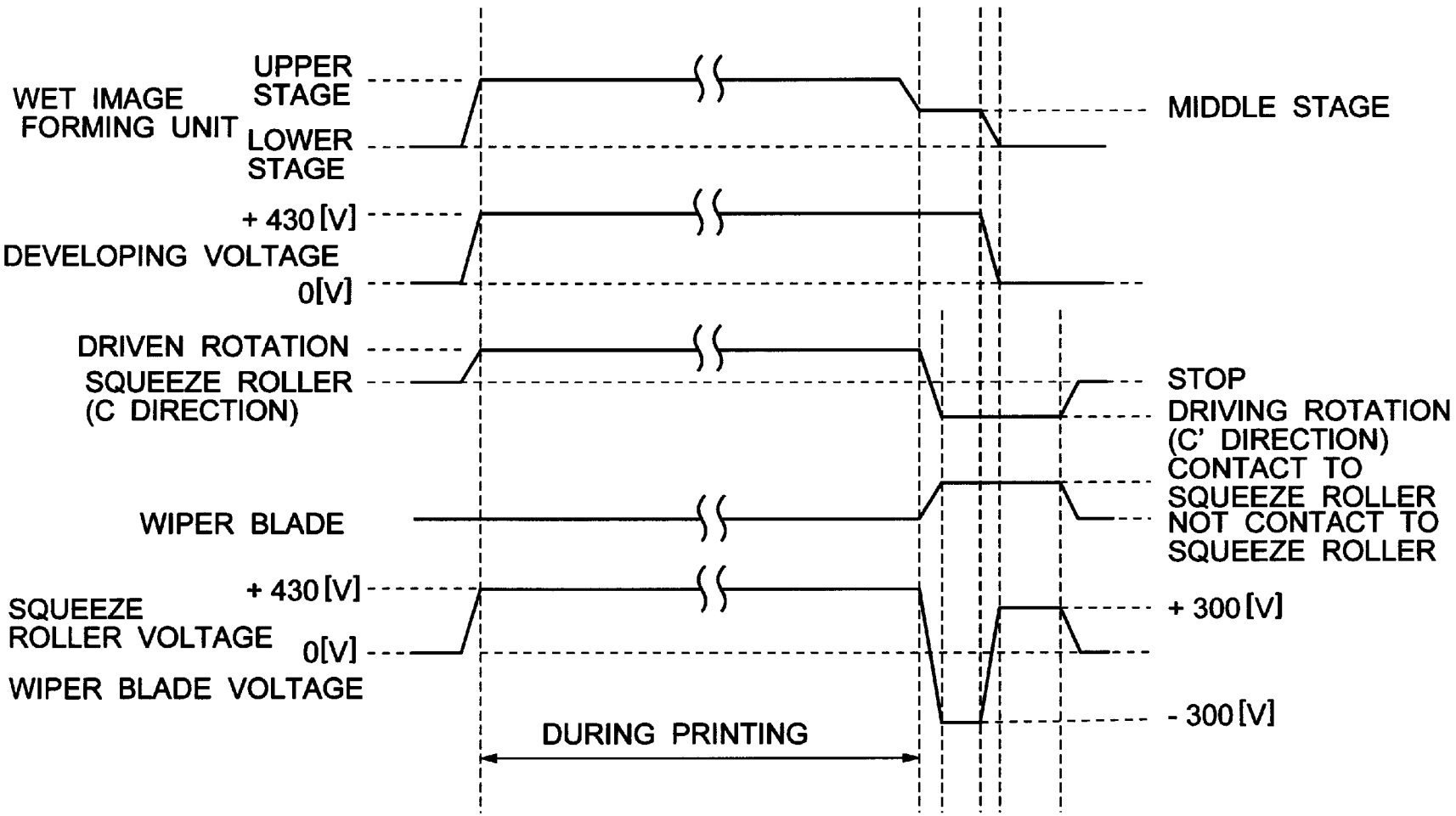
FIG. 7 is a timing chart showing an operational sequence of the wet image forming unit in FIG. 2.

FIG. 3 is a side elevation view showing a state during printing; FIG. 4 a side elevation view showing the first state just before stop of printing; FIG. 5 a side elevation view showing the second state just before stop of printing; FIG. 6 a side elevation view showing a state upon stop of printing; and FIG. 7 a diagram showing an operational sequence of the wet image forming unit 3. Further, FIGS. 8A to 8D are operational detailed diagrams around the squeeze roller 14 and FIG. 8A corresponds to a state in FIG. 3; FIG. 8B a state in FIG. 4; FIG. 8C a state in FIG. 5; and FIG. 8D a state in FIG. 6, respectively.

In the initial state before printing, as shown in FIG. 6, the developing roller 11 and squeeze roller 14 are separated from the photosensitive belt B.

If a printing instruction is transmitted to the control circuit 100 in FIG. 9, the photosensitive belt B begins to move in the direction of the arrow a in FIG. 6 and is charged to +750 [V] by the scorotron charger 1 (in FIG. 1). After that, the liquid developing solution circulating pump (not shown) begins to move and the liquid developing solution containing toner charged to the positive polarity on the surface of the developing roller 11 is supplied from the liquid developing solution supply port 13 in FIG. 2. Simultaneously, the switching circuit S2 in FIG. 9 is shut off and a voltage of +430 [V] is applied to the developing roller 11 and the squeeze roller 14.

The cam 10 for vertically operating the squeeze supporter 18 and the developing roller supporter 19 in the wet image forming unit 3 rotates in the direction of an arrow e in FIG. 6. The squeeze supporter 18 and the developing roller supporter 19 in the wet forming unit 3 are moved from the lower stage (the initial position when the apparatus stops, in FIG. 6) to the upper stage (the position upon printing, in FIG. 3). If the squeeze supporter 18 and the developing roller supporter 19 (FIG. 3) rises at the upper stage, the developing roller 11 is arranged at a position where an interval of 150 [$\mu$m] is held from the photosensitive belt B. At this time, the squeeze roller 14 is pressed to the photosensitive belt B by a force of 12 [kgf] of the compressing coil springs 23*a* and 23*b* in the spring member 23 set between the squeeze roller supporter 21 and spring bearing 22.

The exposing process is executed by the laser unit 2 (in FIG. 1) and the electrostatic latent image is formed on the photosensitive belt B. A potential of the portion (electrostatic latent image) exposed by a laser beam is equal to +130 [V] and is remarkably decreased from the potential of (+750V) of the portion which is not exposed.

By rotating the developing roller 11 in the direction of the arrow b in FIG. 3, the liquid developing solution T supplied from the liquid developing supply port 13 is conveyed to the interval between the photosensitive belt B and developing roller 11. By the electrostatic latent image which reaches this interval on the photosensitive belt B, an electric field causes between the photosensitive belt B and developing roller 11 of +430V and the toner (charged to the positive polarity) in the liquid developing solution is moved to the electrostatic latent image portion (portion of +130V) of the photosensitive belt B by electrophoresis and generates toner developed area. In the portion where the electrostatic latent image is not formed, the voltage is equal to +750V, so that the toner charged to the positive polarity is not so moved to the photosensitive belt B and, inversely, a large quantity of toner is repulsed from the photosensitive belt B.

In FIG. 3, although during developing, the remaining liquid developing solution T which is not developed exists on the outer rim of the developing roller 11, a cleaning process is performed not so as to exert a bad influence on a next development by the cleaning roller 12 to which the liquid developing solution T is oozing.

A surplus liquid developing solution is adhered onto the photosensitive belt B just after development. The surplus liquid developing solution is both a liquid developing solution which adheres to an area other than the toner developed area and the dispersing solution of the liquid developing solution adhered in the developed image.

Figure 8A:
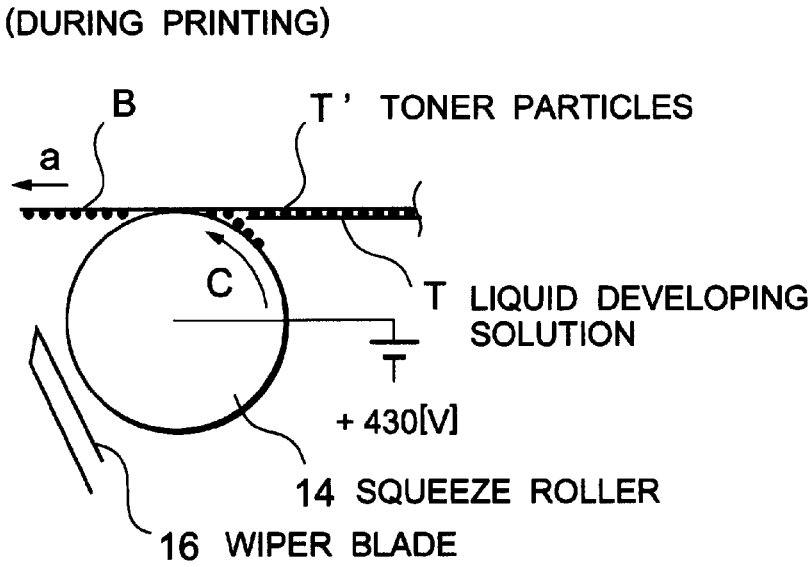
FIG. 8A is a side elevation view showing an operation around a squeeze roller in FIG. 3.
Figure 8B:
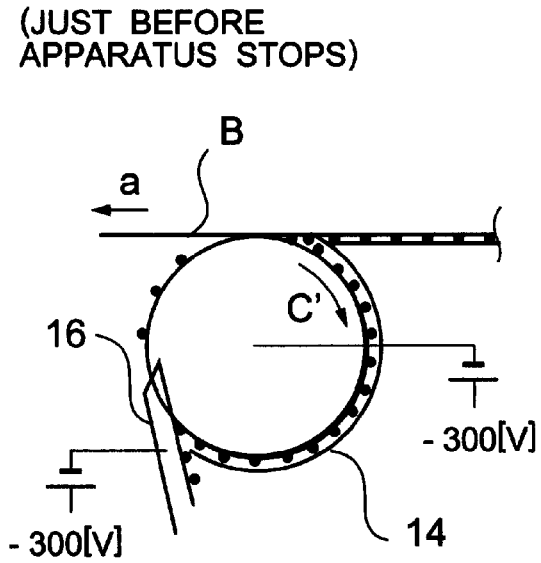
FIG. 8B is a side elevation view showing an operation around a squeeze roller in FIG. 4.
Figure 8C:
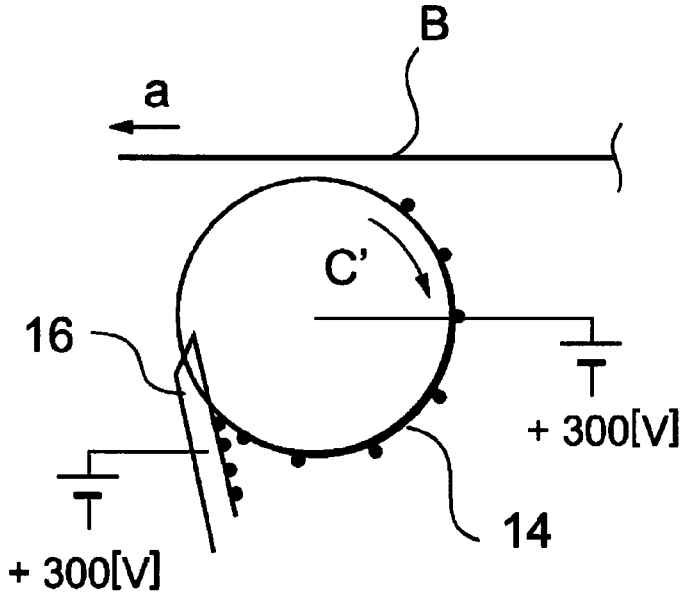
FIG. 8C is a side elevation view showing an operation around a squeeze roller in FIG. 5.
Figure 8D:
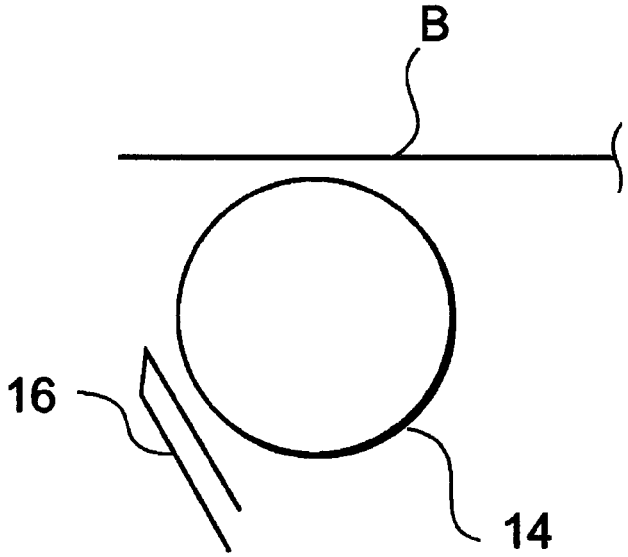
FIG. 8D is a side elevation view showing an operation around a squeeze roller in FIG. 6.

The surplus liquid developing solution, as shown in FIGS. 3 and 8A, is squeezed by the squeeze roller 14 pressed to the photosensitive belt B by a force of 12 [kgf] and the image on the photosensitive belt B becomes like a film. During development, a voltage of +430V is applied to the squeeze roller 14 by the switching circuit S1 in FIG. 9 similarly with the developing roller 11. The toner is electrostatically repulsed so that the toner in the developed image does not adhere to the squeeze roller 14.

At this time, a part of the liquid developing solution T squeezed by the squeeze roller 14 is remained and gathered at the interval between the photosensitive belt B and squeeze roller 14 which is located on the upstream side from the center contact portion of the photosensitive belt B and squeeze roller 14.

After that, further, since the image like a film on the photosensitive belt B needs to be dried, the image is advanced to the drying unit 4 in FIG. 1 and to the transfer unit 7, thereby being transferred to a paper.

When the printing to the control circuit 100 in FIG. 9 by print data is finished, first, the liquid developing solution circulating pump which supplies the liquid developing solution T stops and the cam 10 in FIG. 3 rotates in the counterclockwise direction. Thus, the squeeze supporter 18 and developing roller supporter 19 in the wet image forming unit 3 drop from the position (in FIG. 3) of the upper stage (upon printing) to the intermediate position (in FIG. 4).

As shown in FIG. 4, when the squeeze supporter 18 and developing roller supporter 19 come to the intermediate position, the distance between the squeeze roller supporter 21 and spring bearing 22 is longer than free length of the compressing coil spring 23*a*. Hence, in the spring member 23 existing between the squeeze roller supporter 21 and spring bearing 22, the compressing coil spring 23*a* does not function. Only the compressing coil spring 23*b* having a small spring constant functions and the squeeze roller 14 is pressed to the photosensitive belt B by a force of 0.9 [kgf].

At this time, the switching circuit S1 in FIG. 9 is switched and, as shown in FIG. 8B, a voltage (voltage whose polarity is opposite to the charging polarity (the positive) of the toner contained in the liquid developing solution T) of −300[V] is applied to the squeeze roller 14 from the squeeze terminal 15, and the roller 14 rotates in the direction of an arrow c'. Consequently, during printing, the liquid developing solution T which remains and gathers at the interval between the photosensitive belt B and squeeze roller 14 which is located on the upstream side from the center contact portion of the photosensitive belt B and squeeze roller 14, is pulled near the squeeze roller side and removed by accompanying with a squeezing operation. The surface of the photosensitive belt B is cleaned.

In this instance, the wiper blade 16 to which a voltage whose potential is similar to that of the squeeze roller 14 is applied is pressed to the outer rim surface of the squeeze roller 14 (in FIG. 8B) . The liquid developing solution T is also removed from the outer rim surface of the squeeze roller 14. In the state in FIG. 4, the developing roller 11 and cleaning roller 12 stop.

Moreover, the cam 10 rotates in the direction of the arrow e in FIG. 4. If the squeeze supporter 18 and developing roller supporter 19 in the wet forming unit 3 drop from the intermediate position (upon cleaning, in FIG. 4) to the lower stage (in FIG. 5), the squeeze roller 14 is separated from the photosensitive belt B. Similarly, the switching circuit S1 in FIG. 9 is switched and a voltage of +300[V] (voltage whose polarity is the same as the charging polarity of toner particles T' contained in the liquid developing solution T) is applied to the squeeze roller 14 and wiper blade 16 (in FIG. 8C). As a result, the toner which remains onto the outer rim surface of the squeeze roller 14 and is charged to the polarity opposite to the charging voltage of the toner is fully removed by the wiper blade 16 and is cleaned.

After that, the squeeze roller 14 stops rotating. The wiper blade 16 is separated from the outer rim surface of the squeeze roller 14 by the wiper blade moving mechanism 130 in FIG. 9. The voltage applied to the squeeze roller 14 and wiper blade 16 is completely turned off (in FIG. 8D) and, finally, the photosensitive belt B stops (FIG. 6).

Figure 10:
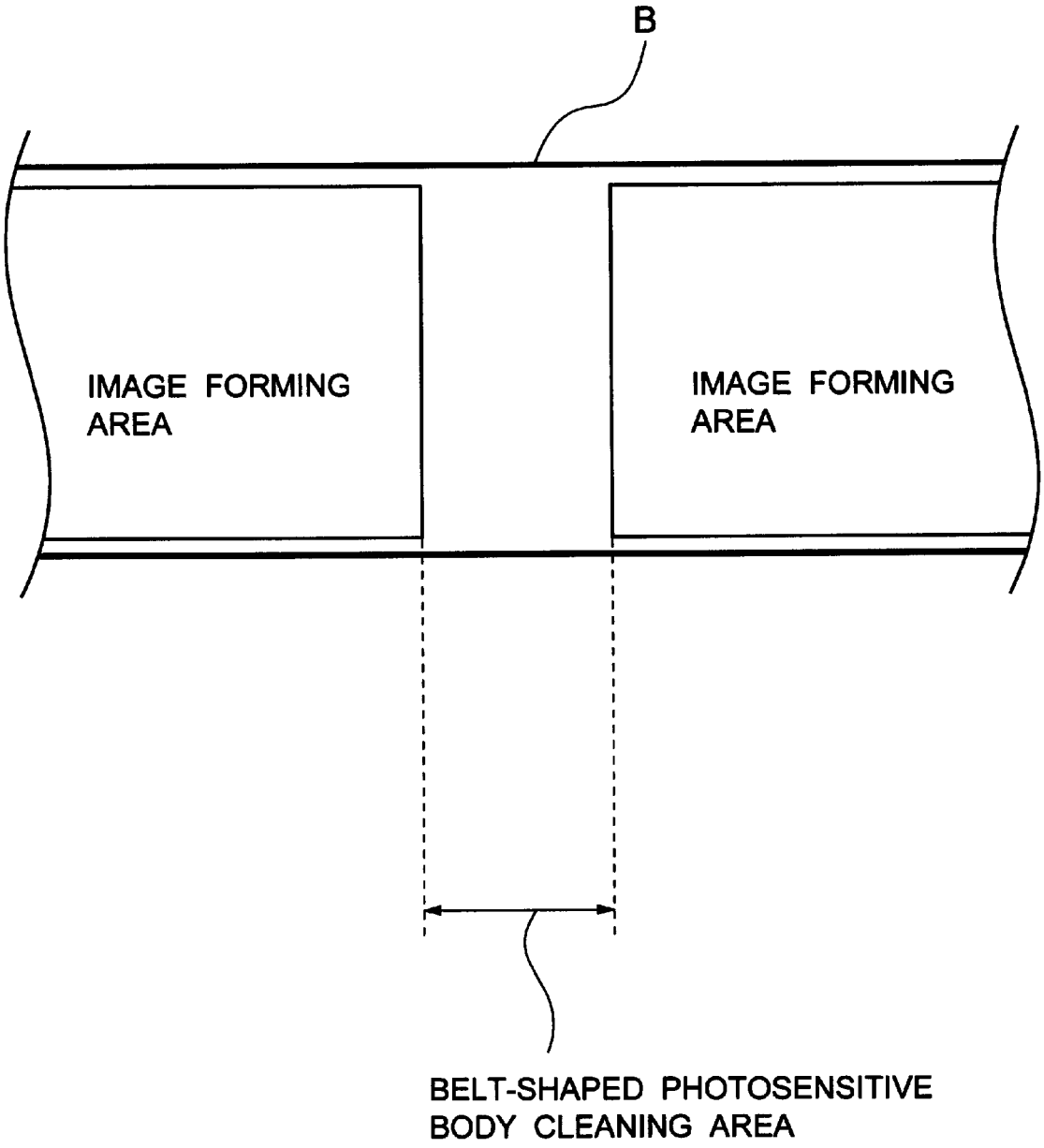
FIG. 10 is a top view of a photosensitive belt of the second embodiment.

The second embodiment according to the present invention will now be described. The construction of a wet image forming unit is the same as that in FIGS. 2 and 3 as mentioned in the first embodiment. FIG. 10 is a top view and a section view of the photosensitive belt B in the second invention.

An operation for cleaning the photosensitive belt B by rotating the squeeze roller 14 in the direction opposite to the moving direction of the surface of the photosensitive belt B is always executed in the same area as that without being used for the image formation of the photosensitive belt B. The area of the photosensitive belt B is mechanically intensified such as by making the belt thicker than another area. Upon cleaning the photosensitive belt B, a force which presses the squeeze roller 14 to the photosensitive belt B is increased (raised from 0.9 [kgf] to 2 [kgf]), and the liquid developing solution T on the photosensitive belt B is strongly rubbed and removed.

By the foregoing operations, a voltage applied to the squeeze roller 14 can be decreased upon cleaning.

As mentioned above, during printing, the same voltage as the developing voltage is applied to the squeeze roller 14 (in FIGS. 3 and 8A) from the squeeze terminal 15 of the plate metal member which contacts with the end of the shaft of the squeeze roller 14. In the spring member 23 of the compressing coil type between the squeeze roller supporter 21 and spring bearing 22, both of the compressing coil springs 23*a* and 23*b* function and the squeeze roller 14 is pressed to the photosensitive belt B by a predetermined force. The squeeze roller 14 is, during printing, driven and rotated in the direction of the arrow c in FIG. 3 by a frictional force by the roller 14 and photosensitive belt B and the surplus liquid developing solution T is squeezed from the liquid developing solution T developed on the photosensitive belt B.

Just before the apparatus stops after completion of printing, a voltage different from that during printing is applied to the squeeze roller 14 from the squeeze terminal 15 (in FIGS. 4 and 8B). In the spring member 23 between the squeeze roller supporter 21 and spring bearing 22, only the compressing coil spring 23*b* functions, and the squeeze roller 14 is pressed to the photosensitive belt B by a predetermined force and rotated in the direction of the arrow c' in FIG. 4. The liquid developing solution T which is gathered at the interval between the photosensitive belt B and squeeze roller 14 during printing is removed and the photosensitive belt B is cleaned.

At this time, the wiper blade 16 to which the same voltage as that of the squeeze roller 14 is applied from the squeeze terminal 15 is come into contact with the outer rim surface of the squeeze roller 14. The liquid developing solution T of the outer rim surface of the squeeze roller 14 is removed and cleaned. After that, when the squeeze roller 14 is separated from the photosensitive belt B (in FIGS. 5 and 8C), a different voltage is also applied to the squeeze roller 14 and wiper blade 16. The liquid developing solution T is completely removed from the outer rim surface of the squeeze roller 14.

As described above, the present invention has an effect such that during printing, a liquid developing solution gathered at the interval between a photosensitive belt and a squeeze roller is not only mechanically removed from the surface of the photosensitive belt and squeeze roller, but also electrically removed and, therefore, when the apparatus stops, the liquid developing solution is substantially completely removed from the photosensitive belt and squeeze roller.

An operation for cleaning the photosensitive belt is always performed in the same area as the area which is not used for image formation, so that there is an effect such that a voltage applied to the squeeze roller can be decreased upon cleaning.

What is claimed is:

1. A wet image forming unit for developing an electrostatic latent image formed on a surface of a photosensitive body which rotates in a predetermined direction by a liquid developing solution containing toner particles upon an image forming operation, comprising:

a developing roller which develops said photosensitive body surface by said liquid developing solution;

a squeeze roller for squeezing a surplus developing solution on said photosensitive body and cleaning, and being arranged on a lower stream side of said developing roller and rotates in a direction similar to a rotating direction of the photosensitive body during image forming operation and rotates in a direction opposite to the photosensitive body while contacting with the photosensitive body just before stop of the image forming operation; and voltage applying circuit which applies a voltage whose polarity is opposite to a charging polarity of said toner particles to said squeeze roller just before said stop of the image forming operation.

2. A wet image forming unit according to claim 1, further comprising a wiper blade for cleaning the liquid developing solution on said squeeze roller, wherein said voltage applying circuit applies a voltage whose potential is the same as that of said squeeze roller to said wiper blade, just before the stop of the image forming operation and said wiper blade contacts with said squeeze roller.

3. A wet image forming unit according to claim 2, further comprising a squeeze roller supporter, wherein after the voltage whose polarity was opposite to the charging polarity of said toner particles was applied to said squeeze roller just before the stop of the image forming operation, said squeeze roller supporter separates said squeeze roller from said photosensitive body, and said voltage applying circuit applies a voltage whose polarity is the same as the charging polarity of said toner particles to said squeeze roller.

4. A wet image forming unit according to claim 3, wherein when said squeeze roller is separated from said photosensitive body, said voltage applying circuit applies the voltage whose polarity is the same as the charging polarity of said toner particles to said wiper blade.

5. A wet image forming unit according to claim 1, wherein upon contacting with an area which is not used for the image formation of said photosensitive body, said squeeze roller rotates in a direction opposite to that upon the image forming operation and cleans.

6. A wet image forming unit according to claim 5, wherein in said photosensitive body, mechanical intensity of the area used for the cleaning by said squeeze roller is higher than that of another portion.

7. An image forming apparatus, comprising:

a charging unit which charges a surface of a photosensitive body;

an exposing unit which exposes the charged portion of said photosensitive body;

a developing unit which develops an electrostatic latent image formed on the surface of the photosensitive body by said exposing unit by a liquid developing solution containing toner particles; and a transfer unit which transfers the developed image by said developing unit to a paper, wherein said developing unit comprises:

a developing roller which develops the electrostatic latent image on said photosensitive body surface by said liquid developing solution;

a squeeze roller for squeezing a surplus developing solution on said photosensitive body and cleaning, and being arranged on a lower stream side of said developing roller and rotates in a direction similar to a rotating direction of the photosensitive body during an image forming operation and rotates in a direction opposite to the photosensitive body while contacting with the photosensitive body just before the stop of image forming operation; and voltage applying circuit which applies a voltage whose polarity is opposite to a charging polarity of said toner particles to said squeeze roller just before said stop of the image forming operation.

8. An image forming apparatus according to claim 7, wherein said developing unit further comprises a wiper blade for cleaning the liquid developing solution on said squeeze roller and, just before said stop of the image forming operation, said voltage applying circuit applies a voltage whose potential is the same as that of said squeeze roller to said wiper blade and said wiper blade contacts with said squeeze roller.

9. An image forming apparatus according to claim 8, further comprising a squeeze roller supporter, wherein after the voltage whose polarity was opposite to the charging polarity of said toner particles was applied to said squeeze roller just before the stop of the image forming operation, said squeeze roller supporter separates said squeeze roller from said photosensitive body, and said voltage applying circuit applies a voltage whose polarity is the same as the charging polarity of said toner particles to said squeeze roller, and when said squeeze roller is separated from said photosensitive body, said voltage applying circuit applies the voltage whose polarity is the same as the charging polarity of said toner particles to said wiper blade.

10. An image forming apparatus according to claim 7, wherein upon contacting with an area which is not used for the image formation of said photosensitive body, said squeeze roller rotates in a direction opposite to that upon the image forming operation and cleans.

11. An image forming apparatus according to claim 10, wherein in said photosensitive body, mechanical intensity of the area used for the cleaning by said squeeze roller is higher than that of another portion.

* * * * *